United States Patent [19]

Ammons

[11] 4,438,049

[45] Mar. 20, 1984

[54] CARBURETOR ENGINE IDLE SPEED AIR BYPASS

[75] Inventor: Edward A. Ammons, Plymouth, Mich.

[73] Assignee: Ford Motor Company, Dearborn, Mich.

[21] Appl. No.: 415,053

[22] Filed: Sep. 7, 1982

[51] Int. Cl.[3] ..... F02M 3/06

[52] U.S. Cl. ..... 261/42; 123/339; 251/117; 251/129; 137/599.2; 137/601; 261/DIG. 74

[58] Field of Search ..... 123/339; 137/601, 599.2; 251/117, 129; 261/DIG. 74, 42

[56] References Cited

U.S. PATENT DOCUMENTS

| | | | |
|---|---|---|---|
| 1,242,245 | 10/1917 | Rutz | 137/599.2 |
| 1,935,350 | 11/1933 | Chandler | 261/41 D |
| 2,943,615 | 7/1960 | Kainz | 123/339 |
| 2,984,256 | 5/1961 | Wildern | 251/117 |
| 3,067,769 | 12/1962 | Skulley | 137/599.2 |
| 3,193,043 | 7/1965 | Korte | 261/63 |
| 3,252,539 | 5/1966 | Ott et al. | 261/41 D |
| 3,608,874 | 2/1969 | Beckmann | 261/41 D |
| 3,645,509 | 2/1972 | Eckert et al. | 261/41 D |
| 4,201,169 | 5/1980 | Michassouridis | 123/339 |
| 4,381,747 | 3/1983 | Kobayashi et al. | 123/339 |

FOREIGN PATENT DOCUMENTS

| | | | |
|---|---|---|---|
| 57-76251 | 5/1982 | Japan | 261/42 |

*Primary Examiner*—Tim R. Miles

*Attorney, Agent, or Firm*—Robert E. McCollum; Clifford L. Sadler

[57] ABSTRACT

An automotive type carburetor is provided with an air bypass channel routing idle speed air flow around the closed throttle valve; the bypass channel containing a spring closed poppet valve having an adjustable volume internal channel connecting air to opposite sides of the valve at all times in a restrictive manner, the movement of the poppet valve and the volume of flow through the internal air flow channel being controlled by a solenoid operated plunger to progressively increase or decrease air flow from a minimum provided by the flow through the internal passage to a maximum provided by flow past the unseated poppet valve in addition to flow through the internal passage.

8 Claims, 4 Drawing Figures

CARBURETOR ENGINE IDLE SPEED AIR BYPASS

Figure 1:
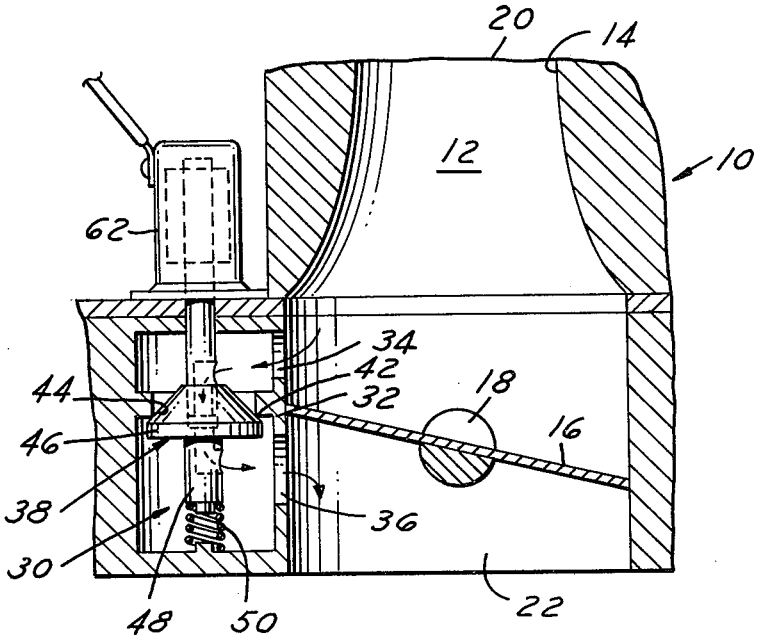

This invention relates in general to an automotive type carburetor, and, more particularly, to valving for controlling the flow of bypass air around the closed throttle valve during engine idle speed operation.

Most carburetors have a separate channel or passage for supplying an air/fuel mixture to the engine during idle speed operation. When an accessory, such as, for example, the air conditioning compressor, or power steering pump, suddenly becomes operative when the engine is at a low idle speed, the extra load may cause stalling if additional air or air/fuel cannot be supplied to the engine at this time. Some carburetors are compensated for this by providing an overrich idle speed mixture. In other cases, an air bypass channel parallel to the main induction passage is provided to flow air around the closed throttle valve to provide a more combustible mixture to thereby provide greater power and a higher idle speed. The air flow through such a bypass has been variably controlled in a variety of ways by either manual, hydraulic, or electrical means.

This invention is directed to such an air bypass construction and provides a two-stage operation providing a variable flow of air by means of selectively controlled solenoid operated valving.

Carburetors are known in the prior art that have an air bypass channel controlled manually, hydraulically or electrically to vary the amount of air bypassed. For example, U.S. Pat. No. 3,608,874, Beckmann, shows a carburetor having an air bypass channel controlled by a manually adjusted needle valve to vary the air flow. U.S. Pat. No. 1,935,350, Chandler, shows a carburetor air bypass channel that includes all the elements of a separate mini carburetor. An adjustable valve 29 is connected to the throttle valve to control the volume of flow of bypass air in conjunction with movement of the throttle valve. U.S. Pat. No. 3,193,043, Korte, shows in FIG. 4 a carburetor having an air bypass channel that is solenoid controlled. U.S. Pat. No. 3,252,539, Ott et al in FIG. 3 also shows a carburetor air bypass channel controlled by a solenoid operated plunger. U.S. Pat. No. 3,645,509, Eckert et al, shows a carburetor having an air bypass channel that includes a temperature responsive poppet type valve.

While each of the above prior art references show valve controlled carburetor air bypass passages or channels, none show dual stage valving variably controlling the air flow first in a restrictive manner and, secondly, in an open manner providing maximum bypass air flow.

It is an object of this invention, therefore, to provide a carburetor air bypass control providing dual-stage operation effecting variably restrictive flow during one stage and maximum flow during a second stage of operation.

It is a further object of the invention to provide a carburetor air bypass control of the type described consisting of a bypass passage having a spring loaded poppet valve to close the passage and provided with an internal passage connecting air to opposite sides of the poppet valve at all times, the internal passage being adjustable to variably restrict the through flow volume as a function of the movement of a solenoid operated plunger also opening the poppet valve at selected times to provide maximum flow through the bypass channel and concurrent flow through the internal passage.

Figure 4:
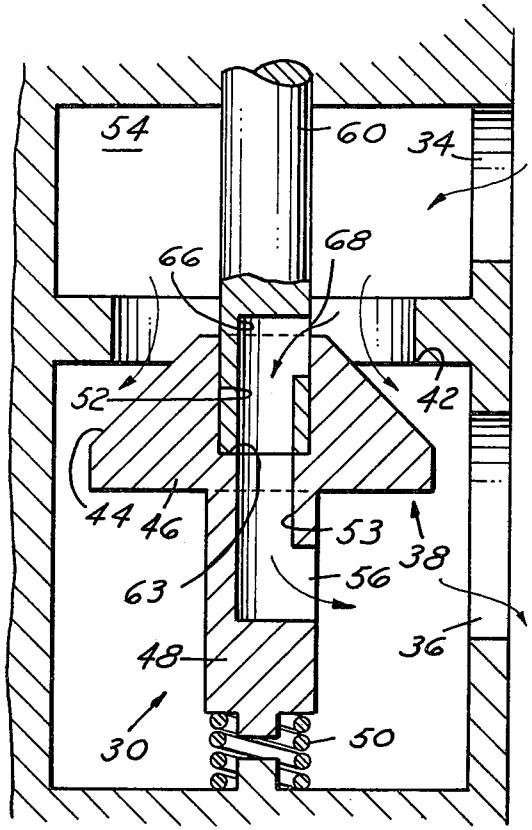
Figure 3:
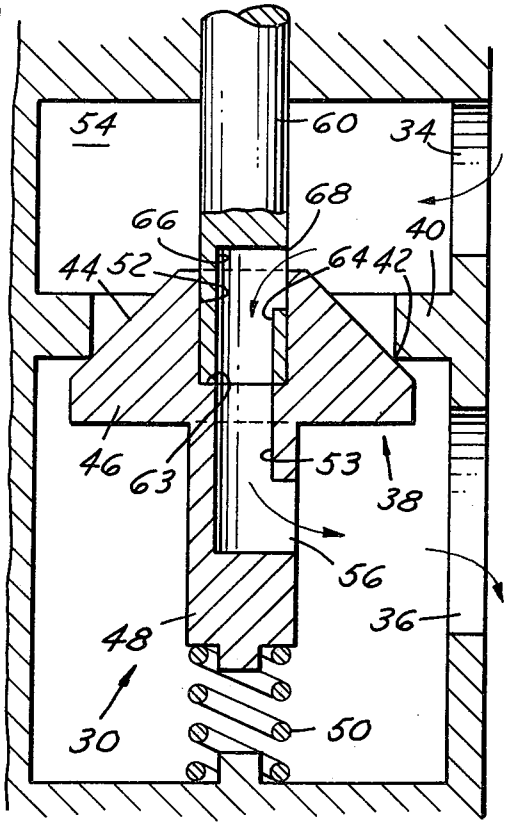
Figure 2:
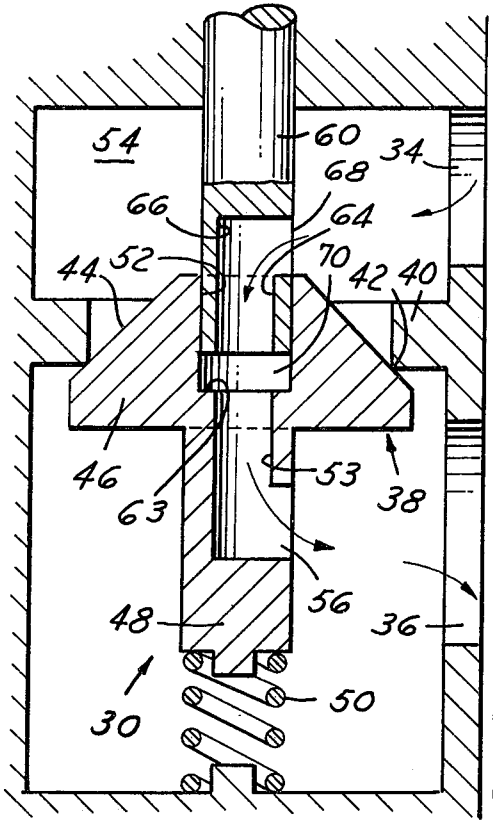

Other objects, features and advantages of the invention will become more apparent upon reference to the succeeding, detailed description thereof, and to the drawings illustrating the preferred embodiment thereof; wherein, FIG. 1 schematically illustrates a cross-sectional view of a portion of a downdraft type carburetor embodying the invention; and, FIGS. 2, 3 and 4 are enlarged views of a detail of FIG. 1 showing the parts in various operative positions.

FIG. 1 illustrates a portion 10 of a downdraft type carburetor having the usual air/fuel induction passage 12 with a fixed area venturi 14. The lower portion of the carburetor contains the usual round throttle valve or plate 16 fixed on a shaft 18 that is rotatably mounted in the side walls of the carburetor for movement of the throttle valve between the essentially closed idle speed position shown and a nearly vertical wide open throttle position.

Induction passage 12 is connected in the usual manner at its upper end 20 to clean air from the engine air cleaner assembly, not shown, and its lower end 22 is adapted to be fixed to and over the intake manifold of the engine, also not shown. The main fuel metering system usually provided in the carburetor and the conventional idle speed air/fuel channel with associated transfer port and idle mixture screw are not shown since they are known and believed to be unnecessary for an understanding of the invention, as are the other conventional details of construction and operation of the carburetor.

Paralleling the main induction passage 12 is an air bypass channel or passage 30 contiguous to passage 12. The carburetor wall 32 adjacent the edge of throttle valve 16 when it is in its closed or idle speed position shown, is provided with a pair of openings 34, 36 that straddle the edge and serve as inlet and outlet, respectively, to bypass channel 30. Located in channel 30 to control the flow of air through the same is a poppet valve assembly 38 shown more clearly in FIGS. 2–4. The body portion of the carburetor defining passage 30 is formed with an annular inwardly projecting flange 40, the sharp edge 42 of which constitutes a seat for the conical face 44 of a conventional poppet valve 46. The latter has a plunger type stem 48 seated against the end of a spring 50 biasing the valve against its seat 42 to normally block passage 30.

Poppet valve 46 is provided with a stepped diameter bore 52, 53 establishing a through passage from one side of the poppet valve to the other at all times. Upper axial bore 52 opens directly into air chamber 54, whereas lower bore 53 is L shaped in cross-section with an outlet 56 aligned with discharge outlet 36 in the carburetor wall.

Slidably movable into main bore 52 is the lower end of a plunger 60 that constitutes the armature of a solenoid 62 (FIG. 1). The lower end 64 of plunger 60 is provided with a matching L-shaped bore 66 of a same diameter as bore 53 in poppet valve stem 48, and with an inlet 68 aligned with the inlet 34 in the carburetor wall.

Solenoid 62, as shown in FIG. 1, is adapted to be connected electrically to a microprocessor or similar computer type so as to be control responsive to various engine operating conditions to energize or de-energize solenoid 62. The movement of plunger 60 would thereby be controlled to selectively increase or decrease air bypass flow around the closed throttle valve and thereby control engine idle speed as a function of load as one criteria.

More particularly, FIG. 2 illustrates the position of valve assembly 38 when solenoid 62 is de-energized and its armature spring biased upwardly to an off position. Such position provides an air gap 70 between the lower end of plunger 60 and the upper end of bore 53 that positions the upper inlet 68 for a maximum opening, as indicated. In this condition, air flow through the carburetor wall inlet 34 into inlet 68 and through the connecting passage and out outlet 56 will provide a predetermined volume of bypass air. This might, for example, correspond to the minimum air flow necessary to prevent stalling of a fully loaded engine at idle speed condition of operation.

FIG. 3 illustrates the position of the parts when solenoid 62 is energized to a point taking up air gap 70 in FIG. 2; i.e., the bottom of plunger 60 is against the shoulder 63 between bores 52 and 53. It will be understood, of course, that the voltage to solenoid 62 can be varied so as to move plunger 60 in a progressive and/or intermittent manner to provide the desired degree of movement of the plunger as it moves into bore 52. In the position shown, FIG. 3 might be illustrative of an unloaded engine operating at idle speed condition, for example. The inlet 68 will be positioned to permit a smaller volume of air bypass through the channel than that illustrated in FIG. 2.

FIG. 4, on the other hand, illustrates a maximum air flow condition of operation upon continued downward movement of the solenoid plunger 60. Movement of the plunger beyond the FIG. 3 position will force poppet valve 46 off its seat to allow air flow past the valve. Additional air will also flow through inlet 68 and out outlet 56 in the valve.

From the foregoing, it will be seen that the invention provides a carburetor idle speed air bypass control having a two-stage operation providing restrictive air bypass flow during one stage and a maximum air bypass flow during the second stage, the operation of the two stages being controlled electrically and selectively by a solenoid operated plunger having an internal passage cooperating with an internal passage through a poppet valve to provide a limited or minimum air flow through the bypass passage at all times.

While the invention has been shown and described in its preferred embodiment, it will be clear to those skilled in the arts to which it pertains that many changes and modifications may be made thereto without departing from the scope of the invention.

I claim:

1. An engine idle speed air flow control for a carburetor having an air induction passage and a throttle valve mounted for a rotatable movement across the passage between a closed engine idle speed position and a wide open position to control the flow of air therethrough, the passage being open to air at one end and adapted to be connected to the engine intake manifold at the other end, an engine idle speed air bypass channel connecting the induction passage on opposite sides of the throttle valve for the bypass of air around the throttle valve when the throttle valve is in a closed position, the control comprising a two-stage bypass control valve in the channel spring biased to a closed position blocking the channel and movable through one stage to an open position to open the channel, a variable volume flow-through passage located in the valve connecting air to opposite sides of the valve at all times for another stage of operation, and means for varying the volume of flow through the valve passage to control the bypass of air.

2. A control as in claim 1, the bypass valve being selectively and variably movable, and solenoid operated means for moving the bypass valve.

3. A control as in claim 1, the flow-through passage having an inlet and an outlet, and a plunger variably movable into the inlet to vary the flow area thereof.

4. A control as in claim 3, wherein the plunger constitutes the armature of a solenoid.

5. A control as in claim 2, the flow-through passage having a tubular like U-shape in cross-section including a base and two adjoining sections at right angles to the base, the base having a movable portion to lengthen the base to separate the adjoining sections, one adjoining section constituting an air outlet opening into the channel on the downstream side of the bypass valve, the other adjoining section constituting an air inlet opening into the channel on the upstream side of the bypass valve and being movable with the movable base part into the bypass valve to progressively restrict the inlet opening.

6. A control as in claim 5, the solenoid operated means including a solenoid having an armature, the bypass valve having a central bore defining the flow-through passage, the armature being movable into the flow-through passage and having an L-shaped passage mateable in an end-to-end relationship with the flow-through passage in the bypass valve, selective movement of the armature selectively moving the inlet into the bypass valve to progressively restrict the inlet.

7. A control as in claim 1, the bypass valve comprising a poppet type valve having a central passage therethrough from one end to the other to communicate air from the upstream to the downstream side of the poppet valve at all times, and means to variably restrict the flow of air through the central passage, the latter means including a solenoid controlled plunger having one end telescopically movable into the upstream end of the central passage, the plunger one end having an L-shape with one part coaxial with the central passage and the other part at right angles thereto constituting an air inlet, the telescopic movement of the plunger end into the central passage progressively moving the inlet into the valve passage to progressively block the inlet.

8. A control as in claim 7, including spring means biasing the poppet valve to a closed position, movement of the plunger to a predetermined position engaging the plunger and poppet valve moving the poppet valve to an open position.

* * * * *